United States Patent [19]

Sullivan

[11] Patent Number: 4,671,036

[45] Date of Patent: Jun. 9, 1987

[54] SHEET ROOFING SYSTEM

[75] Inventor: Andrew M. Sullivan, Fort Wayne, Ind.

[73] Assignee: Protective Coatings, Inc., Fort Wayne, Ind.

[21] Appl. No.: 865,841

[22] Filed: May 22, 1986

[51] Int. Cl.[4] ..... E04D 5/06; E04D 5/14; E04D 19/08

[52] U.S. Cl. ..... 52/518; 52/552; 52/748

[58] Field of Search ..... 52/518, 748, 551, 552, 52/549

[56] References Cited

U.S. PATENT DOCUMENTS 1,237,270 8/1917 Abraham ..... 52/549
4,546,589 10/1985 Seaman ..... 52/748 X

FOREIGN PATENT DOCUMENTS 2358102 5/1975 Fed. Rep. of Germany ..... 52/549
2097036 10/1982 United Kingdom ..... 52/518

*Primary Examiner*—Alfred C. Perham
*Attorney, Agent, or Firm*—Pearne, Gordon, McCoy & Granger

[57] ABSTRACT

A sheet roofing system and the method for forming it are mechanically attached to the roof with a flap having a securing bar held to the roof by screws or other fasteners which extend through holes in the sheet material. The bar and the fasteners and the holes through the flap are covered by the strip of sheet material which is then sealed to present a finished roof having an outer membrane which is free of perforations and other penetrations which could detract from the integrity of the finished roofing system.

16 Claims, 5 Drawing Figures

SHEET ROOFING SYSTEM

BACKGROUND OF THE INVENTION

1. Field of the Invention

This invention relates to a method of covering a roof with sheet roofing material and to the roofing system formed thereby, and in particular, to roofing which is mechanically attached to the roof such as by screws or nails or the like.

2. Description of the Prior Art

Applying a roof to a static structure usually comprises applying sheets of roofing material to the structure over the existing roof or subroof. To secure the sheeting material to the roof, a mechanical attachment is needed. Usually, this mechanical attachment is obtained by using nails or screws which are driven through the sheeting material and into the roof beneath the sheeting material. This mechanical attachment, however, produces undesirable holes through the sheeting material through which the nails or screws extend. The exposure of such holes results in a finished roof which may be prone to leak sooner than a roof without such exposed holes.

To reduce the number of holes, it has been prior practice to overlap the sheets of roofing material and to drive the nails or screws through the double layer of roofing material along the overlap. This reduces the number of holes in the sheeting material and thus reduces the possibility of leaking through the roof. Exposed holes, however, are still present in the finished roof. Another possible solution has been to apply sealer individually to each of the holes. This solution, however, is time consuming and expensive.

SUMMARY OF THE INVENTION

In accordance with the present invention, a roofing system is provided which avoids the presence of any holes through its outer surface. The roofing system of the present invention is mechanically attached using screws or nails or the like which are inserted into the roof or subroof beneath the sheet roofing material. However, the roofing system of the present invention does not provide for a penetrating attachment which would leave holes in the outer surface. Instead, the present invention provides a sheet roofing system without any holes through its outer surface for receiving the penetrating features which could produce premature leaking or other undesirable effects.

In accordance with the present invention, a method is provided for covering a roof with elastomeric sheet roofing material. The method comprises the steps of removing from a storage roll a portion of a strip of elastomeric sheet roofing material having a vulcanized flap extending from one surface of the strip. The method further comprises the step of laying the strip on the roof with the surface of the strip having the flap adjacent to the roof. The flap is secured to the roof by laying a securing bar on top of the flap and installing a plurality of fasteners through the flap and into the roof. A plurality of holes are made in the flap through which the fasteners extend. The method further comprises the step of removing from the storage roll an additional portion of the strip of sheet material. The additional portion of the strip is laid on the roof over the securing bar to completely cover the bar and the fasteners and the holes in the flap through which the fasteners extend.

The steps of the method are then repeated for additional flaps and with additional strips covering the roof.

In accordance with another aspect of the present invention, an elastomeric sheet roofing system is provided which comprises a strip of elastomeric sheet roofing material laid on top of the roof. A portion of the strip has a vulcanized flap which extends from one surface of the strip adjacent to the roof. Means are provided for securing the flap to the roof. The securing means comprises a securing bar on top of the flap and beneath the strip and a plurality of fasteners installed through the flap and to the roof. There are a plurality of holes in the flap through which the fasteners extend. The strip covers the securing bar and the fasteners and the holes in the flap through which the fasteners extend.

DETAILED DESCRIPTION OF THE PREFERRED EMBODIMENT

Figure 1:
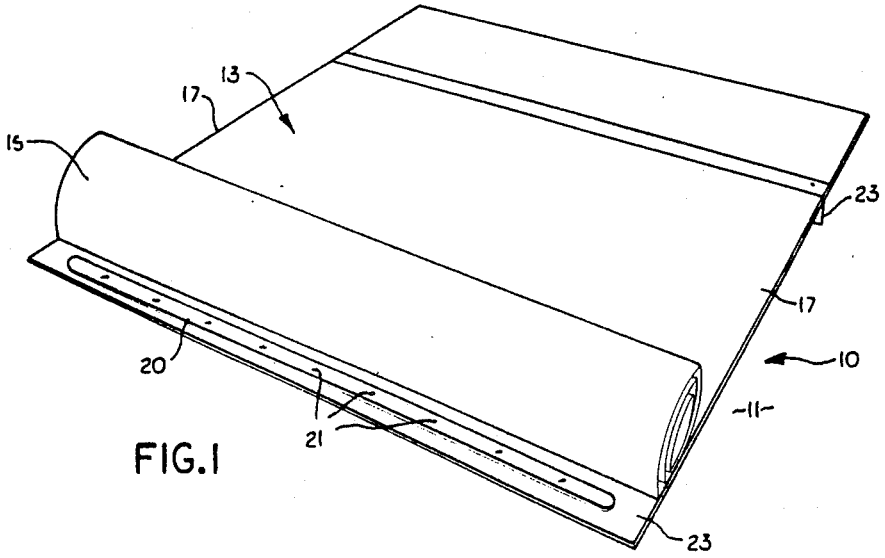
FIG. 1 is a perspective view of the roofing system produced by the method of the present invention.
Figure 2:
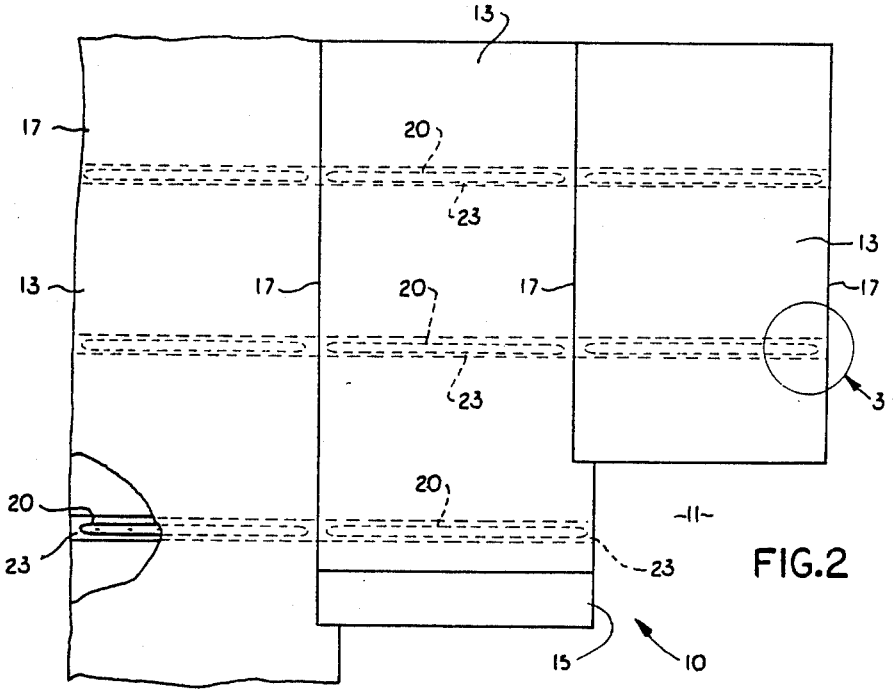
FIG. 2 is a top plan view of the roofing system of FIG. 1.
Figure 3:
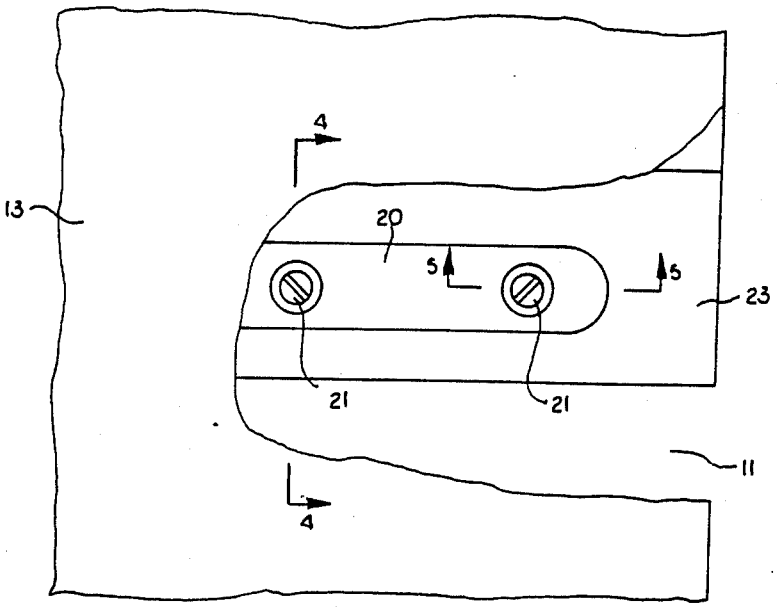
FIG. 3 is a detailed view of a portion of FIG. 2 with a layer of sheeting material removed.

Referring more particularly to the drawings and initially to FIG. 1, there is shown the sheet roofing system 10 of the present invention for installation over a roof 11. The roof 11 may be an existing roof which is in need of re-roofing, or may be a sub-roof in a newly finished structure to which a finished sheet roofing layer has not yet been applied.

In accordance with the present invention, the roof is covered with a plurality of strips 13 of elastomeric sheet roofing material. The strips 13 are removed from a storage roll 15 containing a supply of the sheet roofing material. Each strip removed from the roll 15 has opposite side edges 17. The sheet roofing material is between 40 and 70 mils thick and is preferably 45 to 60 mils thick rubber sheeting. The strips 13 are preferably about 120 inches wide from side edge to side edge 17.

A flap 23 is provided at regular intervals extending from the bottom of the strip 13. Each flap 23 is preferably about 4 inches wide and is vulcanized to increase its elasticity. Each flap 23 extends completely from one side edge of the strip to the other side edge, and extends parallel to the end edges of the strip. The flaps 23 may be formed at the seams of the sheet roofing material which is formed into the strip 13 by overlapping material at the seams to form the flap and then vulcanizing the flap. The flap may be sealed to the end edge of the strip using a suitable adhesive such as a neoprenebased contact adhesive.

Figure 4:
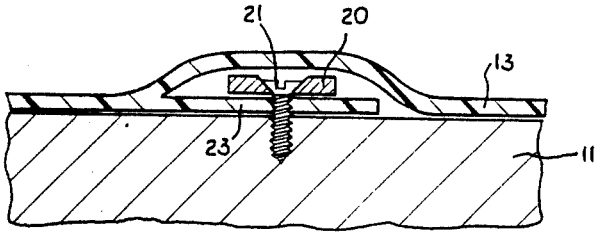
FIG. 4 is a side sectional view taken along line 4—4 of FIG. 3.
Figure 5:
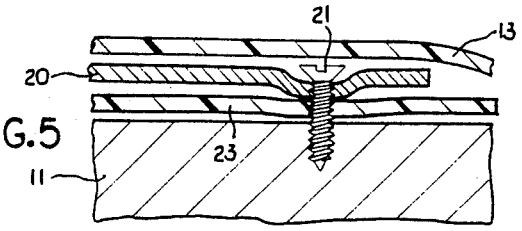
FIG. 5 is an end sectional view taken along line 5—5 of FIG. 3.

A securing bar 20 is installed on top of each of the flaps 23. The securing bar 20 is preferably made of galvanized aluminum and is approximately one inch wide and 1/16 inch thick. The bar 20 is also preferably about 12 inches shorter than the width of the strip 13 to permit a 6-inch overlap of each of the side edges of the strip with the adjacent strip. The securing bar 20 is attached to the roof 11 by means of a plurality of screws 21 or other suitable fasteners which extend through preformed holes in the securing bar 20 and into the roof 11. The bar 20 is preferably recessed at each of the holes, so that the heads of the screws 21 are flush with the bar. As shown in FIG. 4, the strip 13 adjacent to the vulcanized flap 23 overlaps the flap and thereby also overlaps the securing bar 20 and the screws 21. Thus, the holes created by the attachment of the securing bar 20 are completely covered by the flap 23 of the overlapping strip. The finished roofing system provides a continuous outer membrane and presents no outer perforations or penetrating holes which could detract from the integrity of the finished roofing system.

In accordance with the method of the present invention, the roofing system is installed by removing from the roll 15 a strip 13 of the sheet roofing material. The strip is laid on the roof 11. The flaps 23 of the strip 13 are secured to the roof 11 by laying the securing bar 20 on top of the flap and attaching the securing bar to the roof 11 by means of the screws 21 or other suitable fastener which extend through the bar 20 and into the roof. A plurality of holes are thereby made along the flap through which the screws 21 extend. The strip 13 of the roofing material is then further removed from the roll 11 as shown in FIG. 1. As the strip 13 is laid on the roof 11, it overlaps the flap 23 that was just attached to the roof by means of the bar 20. The strip 13 thus completely covers the bar 20 and the screws 21 and the holes in the flap 23 through which the screws 21 extend. After one strip 13 is installed in this manner, another strip 13 is installed beside the first strip. This second strip should overlap the first strip by about 6 inches. As previously described, the securing bars 20 are shorter than the width of the strip to permit this overlap. The second strip is sealed to the first strip by means of a suitable adhesive. This process is repeated for additional strips until the roof is covered.

The finished roofing system provides a continuous membrane which does not contain any other perforations for the mechanical attachment. In addition, the securing bars 20 are completely covered.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A method of covering a roof with elastomeric roofing material, which comprises the steps of:

(a) removing from a storage roll a portion of a strip of unreinforced elastomeric sheet roofing material having a vulcanized flap extending from one surface of the strip;

(b) laying the portion of the strip on the roof with the surface of the strip having the flap adjacent to the roof;

(c) reinforcing and securing the flap to the roof by laying a securing bar on top of the flap, the securing bar having a plurality of holes with a recess at each of the holes forming a protrusion on the bottom of the bar around the hole, installing a plurality of fasteners through the holes in the bar and through the flap and into the roof, a plurality of holes being made in the flap through which the fasteners extend, tightening the screws to apply pressure to the flap where the protrusions engage the flap to reinforce the flap at each hole;

(d) removing from the storage roll and additional portion of the strip of elastomeric sheet roofing material;

(e) laying the additional portion of the strip on the roof over the securing bar to completely cover the bar and the fasteners and the holes in the flap through which the fasteners extend;

(f) repeating steps (c), (d) and (e) for additional flaps on the strip; and (g) repeating steps (a) through (f) with other strips to cover the roof.

2. A method of covering a roof as defined in claim 1, wherein the flap extends across the entire width of the strip.

3. A method of covering a roof as defined in claim 1, wherein the elastomeric material is rubber.

4. A method of covering a roof as defined in claim 3, wherein the elastomeric rubber material is between 40 and 70 mils thick.

5. A method of covering a roof as defined in claim 1, wherein the bar is made of aluminum.

6. A method of covering a roof as defined in claim 1, wherein one edge of the second strip is sealed to the first strip without attachment to the roof.

7. A method of covering as defined in claim 6, wherein the one edge of the second strip is sealed to the first strip using a rubber based adhesive.

8. A method of covering a roof as defined in claim 1, wh.erein each of the strips is at least four feet wide from edge to edge, and the flap is at least two inches wide.

9. An elastomeric sheet roofing system for installation on a roof, which comprises:

a strip of unreinforced elastomeric sheet roofing material laid on top of the roof, a portion of the strip having a vulcanized flap which extends from one surface of the strip adjacent to the roof; and means for reinforcing the flap and securing the flap to the roof, the reinforcing and securing means comprising a securing bar on top of the flap and beneath the strip, the bar having a plurality of holes with a recess at each of the holes forming a protrusion on the bottom of the bar around each hole, and a plurality of fasteners installed through the holes in the bar and through the flap and into the roof, there being a plurality of holes in the flap through which the fasteners extend, the protrusions of the bar applying pressure to the flap to reinforce the flap at each hole, the strip covering the securing bar and the fasteners and the holes in the flap through which the fasteners extend.

10. An elastomeric sheet roofing system as defined in claim 9, wherein the flap extends across the entire width of the strip.

11. An elastomeric sheet roofing system as defined in claim 9, wherein the elastomeric material is rubber.

12. An elastomeric sheet roofing system as defined in claim 9, wherein the strip is between 40 and 70 mils thick.

13. An elastomeric sheet roofing system as defined in claim 9, wherein the bar is made of aluminum.

14. An elastomeric sheet roofing system as defined in claim 1, comprising in addition a second strip adjacent to the aforesaid strip, one edge of the second strip being sealed to the first strip without attachment to the roof.

15. An elastomeric sheet roofing system as defined in claim 14, wherein the one edge of the second strip is sealed to the first strip by means of a rubber based adhesive.

16. An elastomeric sheet roofing system as defined in claim 9, wherein each of the the strips is at least four feet wide from the edge to edge, and the flap is at least two inches wide.

* * * * *